United States Patent [19]

Julien

[11] 4,276,017

[45] Jun. 30, 1981

[54] GAS TORCH

[76] Inventor: Earl W. Julien, 700 Holland La., NE., Minneapolis, Minn. 55432

[21] Appl. No.: 74,498

[22] Filed: Sep. 11, 1979

[51] Int. Cl.[3] ..... F23D 13/04

[52] U.S. Cl. ..... 431/344; 431/343; 126/271.2 R

[58] Field of Search ..... 431/344, 343, 345, 352, 431/353; 248/176, 163; 126/92 B, 271.2 R, 271.2 A, 271.2 C

[56] References Cited

U.S. PATENT DOCUMENTS

| | | | |
|---|---|---|---|
| 1,692,734 | 11/1928 | Haslett | 431/344 |
| 3,179,156 | 4/1965 | Weiss et al. | 431/343 |

FOREIGN PATENT DOCUMENTS

| | | | |
|---|---|---|---|
| 1137962 | 1/1957 | France | 431/344 |

*Primary Examiner*—James C. Yeung
*Attorney, Agent, or Firm*—Harvey B. Jacobson

[57] ABSTRACT

An elongated wand defining pipe structure including inlet and outlet ends is provided. The inlet end may have a source of flammable gas under pressure communicated therewith and the outlet end includes discharge structure for discharging a jet of the gas from the pipe structure. A generally cylindrical shroud is loosely telescoped over the outlet end of the pipe structure and shroud support structure is carried by the pipe structure intermediate the inlet and outlet ends with the support structure defining a generally cylindrical recess opening outwardly at one end thereof along the pipe structure toward the discharge structure. One end of the shroud is removably and supportively telescoped into the recess and the other end of the shroud projects endwise outwardly beyond the discharge structure.

3 Claims, 4 Drawing Figures

GAS TORCH

BACKGROUND OF THE INVENTION

Portable gas torches are utilized for many different purposes. One great usage of portable gas torches resides in the clearing of unwanted vegetation from land. In the past, many different forms of portable torches heretofore have been designed including those torches and other similar structures disclosed in U.S. Pat. Nos. 1,082,619, 1,295,349, 2,144,491, 2,855,987, 3,029,807, 3,737,281, and 3,796,207.

However, these previously known forms of torches and other similar structures are for the most part expensive for manufacture, require experience to operate efficiently and are difficult to control as to the type of flame to be generated thereby.

Various forms of ground vegetation to be cleared by burning require different types of flame. More heavy ground vegetation requires a more concentrated and hotter flame than smaller and perhaps more dense ground vegetation. Accordingly, a need exists for a portable torch whereby the type and intensity of the flame generated thereby may be readily tailored to the specific type of burning or heating operation to be carried out.

The main object of this invention is to provide a portable torch capable of being readily modified in the field to produce different types of flames of different intensity.

Another object of this invention is to provide a portable torch which may be readily disassembled and compactly stored during periods of nonuse.

Still another important object of this invention is to provide a portable torch which may have the basic working components thereof readily disassembled for maintenance operations.

A final object of this invention to be specifically enumerated herein is to provide a portable torch in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
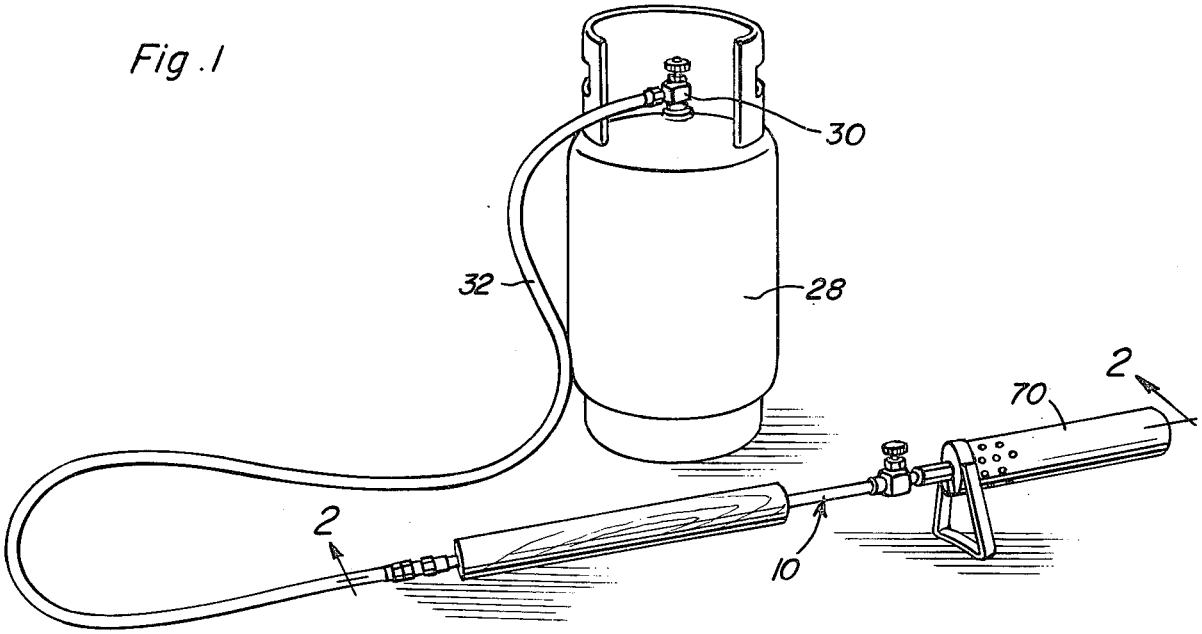
FIG. 1 is a perspective view of the torch operatively associated with a pressurized container of gas.
Figure 2:
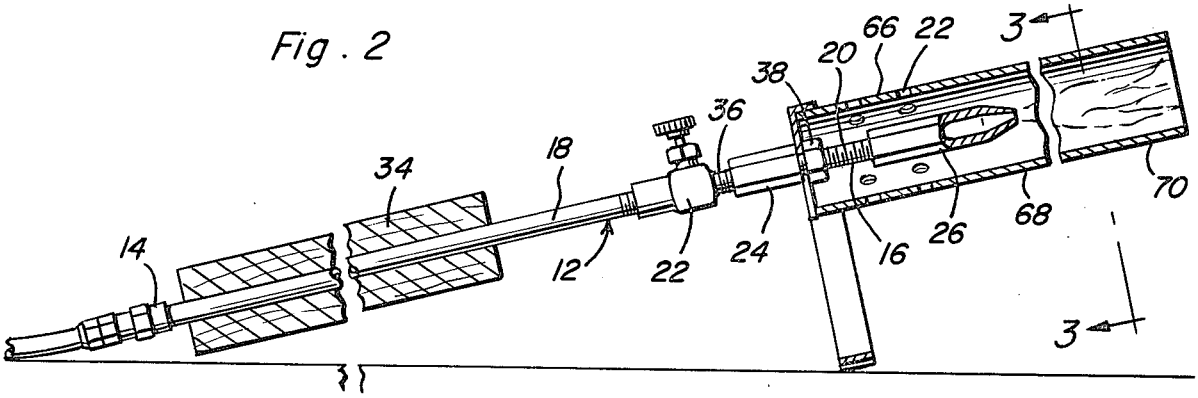
FIG. 2 is an enlarged fragmentary vertical sectional view taken substantially upon the plane indicated by the section line 2—2 of FIG. 1.
Figure 3:
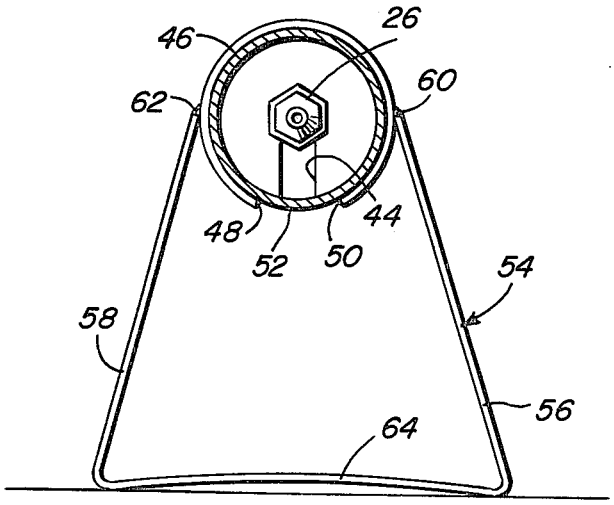
FIG. 3 is an enlarged vertical sectional view taken substantially upon the plane indicated by the section line 3—3 of FIG. 2.
Figure 4:
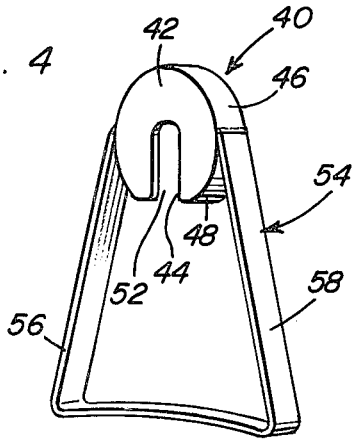
FIG. 4 is a perspective view of the combined stand and shroud support structure of the torch.

Referring now more specifically to the drawings, the numeral 10 generally designates the torch of the instant invention. The torch 10 includes elongated pipe structure referred to in general by the reference numeral 12 and including inlet and outlet ends 14 and 16. The pipe structure 12 consists of first and second inlet and outlet pipe sections 18 and 20, a control valve 22, an internally threaded sleeve 24 disposed between the pipe sections 18 and 20 and a discharge or outlet nozzle 26 threaded onto the discharge end of the pipe section 20.

The torch 10 is operatively associated with a container 28 of compressed gas and the container 28 includes an outlet and control valve 30 and a flexible hose 32 communicating the outlet and control valve 30 with the inlet end 14 of the pipe structure 12.

The pipe section 18 has an insulative sleeve 34 disposed thereover for use as a handle and the sleeve 34 may be constructed of any suitable insulative material such as wood. The control valve 22 is threaded onto the outlet end of the pipe section 18, the sleeve 24 is threaded onto the externally threaded outlet neck 36 of the control valve 22 and the inlet end of the pipe section 20 is threaded into the end of the sleeve 24 remove from the control valve 22.

The outlet nozzle 36 is threaded onto the outlet end of the pipe section 20 and an abutment nut 38 is threaded on the externally threaded pipe section 20 intermediate the sleeve 24 and the outlet nozzle 26, a circumferential radially outwardly opening groove on the pipe section 20 being defined between the opposing ends of the sleeve 24 and nut 38.

A support structure referred to in general by the reference numeral 40 is provided and the support structure 40 includes a generally circular base plate 42 having a radial slot 44 formed therein. The support structure 40 further includes a partial cylindrical peripheral wall 46 including spaced opposite ends 48 and 50 defining a throat 52 therebetween registered with the outer end of the slot 44. Also, the support structure 40 includes an elongated leg assembly referred to in general by the reference numeral 54 supported and extending outwardly therefrom in the direction in which the slot 44 opens. The leg assembly 54 includes a pair of slightly outwardly divergent leg members 56 and 58 secured at their convergent ends to opposite side portions of the peripheral wall 46 as at 60 and 62. The divergent outer ends of the leg members 56 and 58 are interconnected by an integral bight portion 64 extending therebetween, the bight portion 64 being slightly arcuate with its concave side facing in the direction in which the leg assembly 54 projects from the base plate 42.

In assembling the torch 10, the nut 38 is threaded away from the opposing end of the sleeve 24 a distance whereby the groove defined between the sleeve 24 and nut 38 is at least slightly wider than the thickness of the base plate 42. Then, the outlet nozzle is forwardly advanced into the opening defined between the leg members 56 and 58 and the pipe section 20 is thereafter upwardly displaced whereby those portions of the base plate 42 defining the slot 44 will be received in the groove defined between the adjacent ends of the sleeve 24 and the nut 38. Thereafter, with the base plate 42 being axially displaced into engagement with the opposing end of the nut 38, the support structure 40 may be rotated relative to the pipe section 20 in order to rotate the nut 38 (by frictional engagement of the base plate 42 with the nut 38) toward the opposing end of the sleeve 24 whereby the nut 38 may be tightened in order to clamp those portions of the base plate 42 defining the inner extremity of the slot 44 between the nut 38 and the sleeve 24. Thereafter, the base end 66 of a cylindrical shroud 68 may be telescoped into the peripheral wall 46 of the support structure 40 with the base end 66 of the shroud 68 abutted against the side of the base plate 42 remote from the control valve 22. The outer or outlet end 70 of the shroud 68 projects outwardly beyond the outlet nozzle 26. Further, the base end 66 of the shroud 68 is provided with circumferentially and longitudinally spaced radial openings therein for combustion air to enter the base end of the shroud 66 and admix with combustible gas being discharged in jet fashion from the outlet nozzle 26.

It is to be noted that the shroud 68 is frictionally retained in supported position from the support structure 40 and that it may therefore be readily replaced if a shroud having more or less combustion air inlet openings 72 formed therein is desired. In addition, a shroud of a different length may be readily substituted for the shroud 68. Also, inasmuch as the shroud 68 may be readily removed, the outlet nozzle 26 may be readily changed and substituted for by an outlet nozzle having a different diameter discharge aperture in the outlet end thereof. Accordingly, in conjunction with the variable control valve 22, the type and intensity of flame to be generated by torch 10 may be readily varied according to the need.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A gas torch for using a gaseous fuel, said torch including elongated wand defining pipe means including inlet and outlet ends, said inlet end being adapted for connection with a source of flammable gas under pressure, said outlet end including discharge means for discharging a jet of said gas, a generally cylindrical shroud loosely telescoped over said outlet end and discharge means, a shroud support structure carried by said pipe means intermediate said inlet and outlet ends, said support structure defining a generally cylindrical recess opening outwardly at one end thereof along said pipe means toward said discharge means, one end of said shroud being removably and supportively telescoped in said recess, the other end of said shroud projecting endwise outwardly beyond said discharge means, said support structure including a generally circular base plate portion provided with a radial slot opening radially outwardly of one peripheral portion of said base plate portion, a partial cylindrical peripheral wall extending about and supported from said base plate portion and including spaced ends defining a throat therebetween aligned with the outer open end of said slot, said peripheral wall projecting outwardly of one side of said base plate portion and defining, in conjunction with said base plate portion, said recess in which said one end of said shroud is supportively telescoped, said shroud including a peripheral portion thereof at said one end at least substantially fully closing said throat, said pipe means including axially spaced abutment portions defining a narrow circumferential radially outwardly opening groove therebetween, the portions of said base plate portion defining the inner end of said slot being receivable in said groove, at least one of said pipe means abutment portions being threadedly adjustable on said pipe means for adjustably varying the width of said groove and clamping said base plate portions defining the inner end of said slot in said groove, said one end of said shroud including combustion air admitting radial openings formed therein, said radial slot, outward of said pipe means and inward of said shroud also defining combustion air inlet means.

2. The combination of claim 1 wherein said pipe means includes a control valve intermediate said inlet end and said groove.

3. The combination of claim 1 wherein said support structure includes elongated leg means extending outwardly generally in the same direction in which said slot opens.

* * * * *